US011445298B2

(12) United States Patent
Cardona Cano et al.

(10) Patent No.: US 11,445,298 B2
(45) Date of Patent: Sep. 13, 2022

(54) DEVICE FOR BINAURAL CAPTURE OF SOUND

(71) Applicants: UNIVERSIDAD SAN BUENAVENTURA MEDELLÍN, Medellín (CO); UNIVERSIDAD DE MEDELLÍN, Medellín (CO)

(72) Inventors: Cesár Alonso Cardona Cano, Medellín (CO); Ricardo Andrés Moreno Viasus, Medellín (CO); Luis Alberto Tafur Jiménez, Medellín (CO)

(73) Assignee: UNIVERSIDAD SAN BUENAVENTURA MEDELLIN UNIVERSIDAD DE MEDELLÍN, Medellín (CO)

( * ) Notice: Subject to any disclaimer, the term of this patent is extended or adjusted under 35 U.S.C. 154(b) by 0 days.

(21) Appl. No.: 16/098,804

(22) PCT Filed: May 5, 2017

(86) PCT No.: PCT/IB2017/052645
§ 371 (c)(1),
(2) Date: Nov. 2, 2018

(87) PCT Pub. No.: WO2017/191616
PCT Pub. Date: Nov. 9, 2017

(65) Prior Publication Data

US 2019/0132680 A1 May 2, 2019

(30) Foreign Application Priority Data

May 6, 2016 (CO) ..... 16-119184

(51) Int. Cl.
*H04R 5/027* (2006.01)
*H04R 1/00* (2006.01)
(Continued)

(52) U.S. Cl.
CPC ..... *H04R 5/027* (2013.01); *H04R 1/00* (2013.01); *H04R 3/005* (2013.01); *H04S 3/008* (2013.01);
(Continued)

(58) Field of Classification Search
CPC ..... H04R 5/027; H04R 1/00; H04R 3/005; H04R 2201/401; H04R 2420/01;
(Continued)

(56) References Cited

U.S. PATENT DOCUMENTS 4,119,798 A * 10/1978 Iwahara ..... H04S 3/002 381/19
2008/0056517 A1 3/2008 Algazi et al.
2010/0104118 A1 4/2010 Sasidharan et al.
2014/0198918 A1 7/2014 Li et al.
2017/0347170 A1* 11/2017 Liao ..... F16M 11/2021

FOREIGN PATENT DOCUMENTS

ES 2588394 A1 11/2016
WO 2004039123 A1 5/2004
WO 2017191616 A1 11/2017

OTHER PUBLICATIONS

Binaural Enthusiast, website description of item B1-E "http://binauralenthusiast.com/product/etiam-ullamcorper-dollor-3/" dated Apr. 30, 2016, extracted from archive.org (Year: 2016).*
(Continued)

*Primary Examiner* — Paul Kim
*Assistant Examiner* — Douglas J Suthers
(74) *Attorney, Agent, or Firm* — Polsinelli PC

(57) ABSTRACT

This invention corresponds to a device for binaural capture of sound comprising an upper module, a first external ear and a second external ear incorporated into the upper module in a removable way; two transducers, a transducer is arranged in the first external ear and the other transducer is arranged in the second external ear; and, a clamping-coupling located in the lower part of the upper module.

7 Claims, 16 Drawing Sheets

(51) Int. Cl.

| | |
|---|---|
| ***H04R 3/00*** | (2006.01) |
| ***H04S 3/00*** | (2006.01) |
| ***H04S 7/00*** | (2006.01) |
| *H04S 1/00* | (2006.01) |

(52) U.S. Cl.
CPC ..... *H04S 7/30* (2013.01); *H04R 2201/401* (2013.01); *H04S 1/00* (2013.01); *H04S 2400/15* (2013.01); *H04S 2420/01* (2013.01)

(58) Field of Classification Search
CPC ..... H04S 3/008; H04S 7/30; H04S 2400/15; H04S 1/00
USPC ..... 381/26
See application file for complete search history.

(56) References Cited

OTHER PUBLICATIONS

International Search Report and Written Opinion; PCT Application No. PCT/IB2017/052645; dated Aug. 17, 2017.
G.R.A.S Sound & Vibration, "KEMAR," Published Apr. 4, 2013; retrieved from https://web/archive.org/web/20130404113735/http://kemar.us on Oct. 17, 2018.
English Abstract of ES2588394; retrieved from www.espacenet.com on Nov. 2, 2018.
English Translation of ES2588394 retrieved from www.espacenet.com.

* cited by examiner

A)

B)

A)

B)

A)

B)

DEVICE FOR BINAURAL CAPTURE OF SOUND

CROSS-REFERENCE TO RELATED APPLICATIONS

This application is a national stage entry of PCT/IB2017/052645, filed May 5, 2017, which claims priority to Colombian application number 16-119184, filed May 6, 2016, each of which is expressly incorporated, in its entirety, for all purposes herein.

FIELD OF INVENTION

The present invention corresponds to devices for capturing sound signals having specialized components for recreating a multidimensional sound environment, specifically to recreate binaural sound (two-channel sound).

DESCRIPTION OF PRIOR ART

The techniques for capturing direct sound in audiovisual media are normally specified based on monaural capture formats, whose further audio processing allows the expansion of the signal to stereo or surround formats. However, the noticeable effects of spatiality are restricted to mixing processes used in postproduction. Although the binaural capture of sound has been known for decades, there are few implementations in the area of audiovisual production, partly due to lack of practical methodologies and devices that enable them to be used in the field, to capture live sound.

Document WO1996010884 A1 discloses a device that allows a manual camera to record binaural sound. The accessory consists of artificial ears with microphones mounted on both sides of the camera, and a circuit for processing three-dimensional sound. Although the implementation of artificial ears maintains the separation given by the camera, there is no correspondence with the average distance of a human head. In addition, the shape of the camera does not maintain coherence with the morphology of a human head, what limits the production of three-dimensional sound images, consistent with the staging and visual perspective frame. The camera operation is obstructed by the ears added as an accessory on each side of the camera. The document proposes the use of a case housing camera; however, in this case, the hands must enter inside the case to operate the camera, which is not practical for camera maneuvering in a field production.

Document U.S. Pat. No. 8,045,840 B2 discloses an audio/video recording device having a camera, a stereophonic microphone and binaural microphones. Binaural microphones are inserted into the ears of the cameraman, or alternatively in an artificial head. In the case of inserting microphones in the ears of the cameraman, there runs the risk of placing the left and right microphones on opposite ears generating a reversion of binaural image. It also runs the risk that the cameraman generates involuntary movements of the head relative to the perspective of the camera, which can cause distortion in the binaural images obtained in relation to the image. The modifications made to the binaural microphone comprise a support which moves up and down the microphone diaphragm. Although they avoid obstructing the ear cameraman, they distort the transfer function associated with the head. Because of this distortion of the transfer function, this binaural microphone fails to achieve the binaural capture effect according to human perception.

Document U.S. Pat. No. 5,778,083 discloses a device coupled to video cameras capable of capturing sound through five microphones symmetrically distributed around a sphere to provide 5.1 surround sound format. The device lacks auditory pavilions and its dimensions are not comparable to a human head what make it impossible to perform captures faithful to the binaural effect provided by an artificial head.

In consequence, it would be advantageous to provide a portable device, adaptable to video cameras in order to make a sound binaural capture according to the perception captured by a human being; that can be used in a practical way in audiovisual production and post production in field or recording studio.

BRIEF DESCRIPTION OF THE INVENTION

This invention refers to a device for binaural capture of sound comprising an upper module, a first external ear and a second external ear, two transducers and a clamping-coupling. The first external ear and the second external ear are incorporated into the upper module in a removable way. One transducer is arranged in the first external ear and the other transducer is arranged in the second external ear. The clamping-coupling is located in the lower portion of the artificial head. In one modality of the invention, the device for binaural capture comprises a lower module. The lower module is coupled to the bottom of the upper module, forming an artificial head. The artificial head has the shape of a human head and both the first external ear and the second external ear have the shape of a human ear.

The configuration of the device for binaural capture allows adapting video cameras in order to obtain three-dimensional sound images from a production step that are coherent with the staging and the perspective of the visual framing. Moreover, the device is also easily adapted to tripods and floor stands, making it a useful tool in post-production stages, for example, for recording dialogues in studio, Foley effects and musical instruments for sound band. Owing to the modularity of the device for binaural capture that allows removing the lower part of the head keeping the features of the binaural sound capture such as the localization, spaciousness and depth of sound sources, the maneuverability of the technical staff is improved for handling and operating audio and video capture devices.

DETAILED DESCRIPTION OF THE INVENTION

Figure 1:
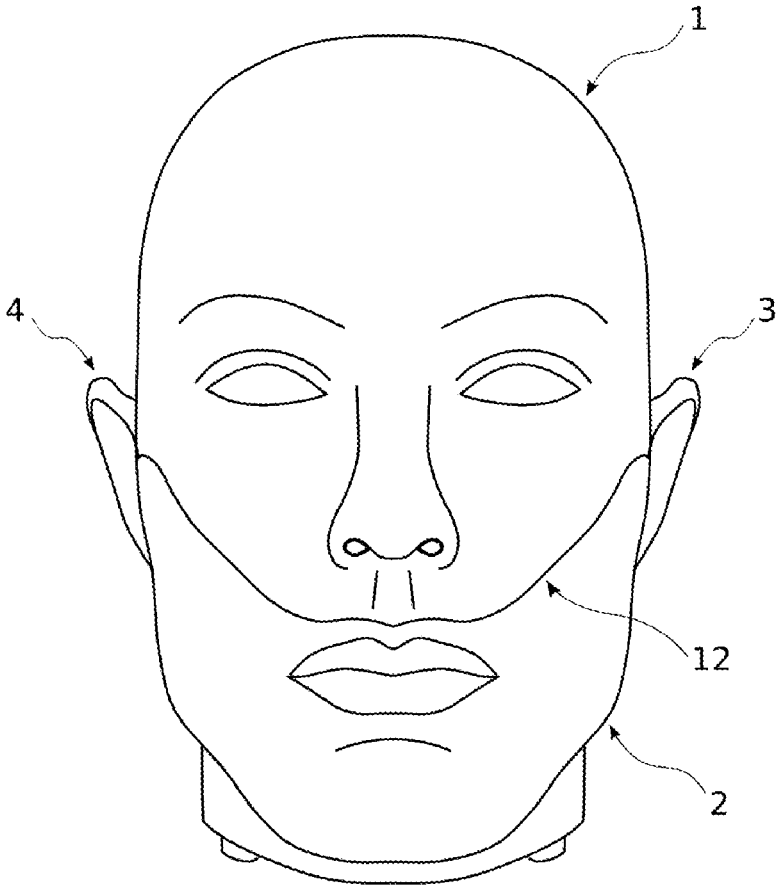
FIG. 1 is a front view of the device for binaural capture of sound.

The present invention relates to a device for binaural capture of sound comprising:

- an upper module (1);
- a first external ear (3) and a second external ear (4) incorporated into the upper module (1) in a removable way;
- two transducers (5), a transducer (5) is arranged in the first external ear (3) and the other transducer (5) is arranged in the second external ear (4); and,
- a clamp-coupling device (7) located below the upper module (1).

It will be understood in the present invention that external ear is the set comprised by an apparatus helically located on each side of the head, known as the pinna (8), and a conduit leading from the surface of the pinna (8) to the transducer membrane (5) microphone type. The described conduit is also called external auditory canal (9). Furthermore, the term "longitudinal axis of the head" will be understood as the axis that is directed downward from the top of the head and passes the upper module (1).

Both the folds of the pinna (8) and the size and shape of the head including the face, interfere in sound producing changes in its frequency spectrum before reaching the transducer (5). Reflections and diffractions which are produced in the wavefronts due to the shapes of the different parts of the device for binaural capture, create the corresponding function transfer related to the head (known in English as head related transfer function), hereinafter HRTF (by its acronym in English).

Figure 8:
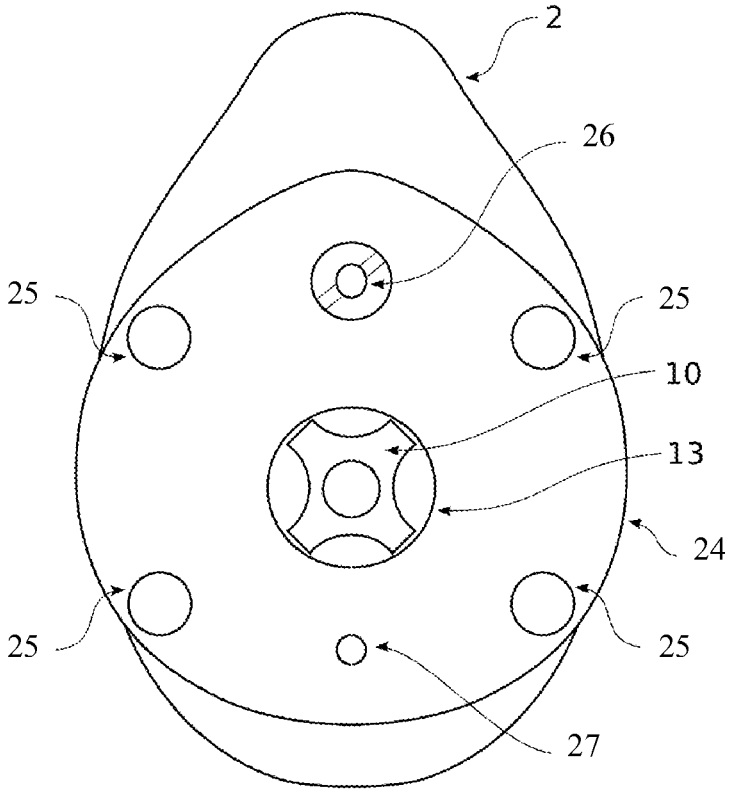
FIG. 8 corresponds to a bottom view of the device for binaural capture in one embodiment of the invention.

Referring to FIG. 1 and FIG. 8, in one embodiment of the invention a lower module (2) is coupled to the upper module (1), configuring an artificial head. The lower module (2) is located beneath the upper module (1). The upper module (1) includes a first external ear (3) and a second external ear (4), both in a removable way, as for example, pulling them out of the device. The upper module (1) is coupled to the lower module (2) by an adjusting nut (10) located below the lower module (2).

Referring to FIG. 1, in one embodiment of the invention, the artificial head comprises the upper module (1) and the lower module (2) has a front face with morphology of a human face and describes physical features for nose, eyes, chin and mouth. The first external ear (3) and the second external ear (4) have the morphology of a human ear. The same maintain anthropometric similarity with an average human ear as described for example by ANSI S3.36: 1985 regulation.

Henceforth it is understood that the configurations and embodiments of the invention that are described for the first external ear (3), will be applied to the second external ear (4), maintaining the symmetry given by the human head morphology.

Figure 2:
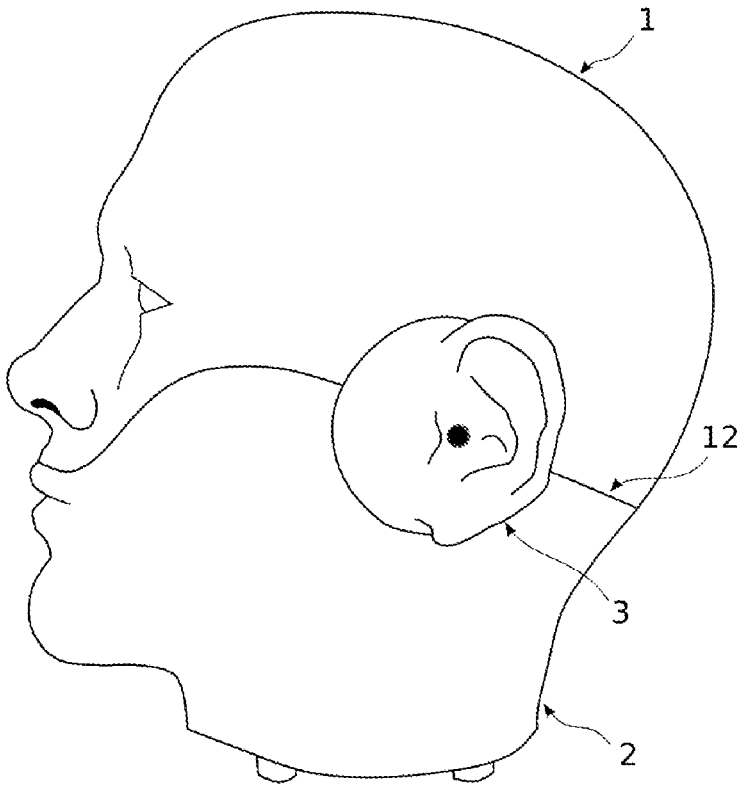
FIG. 2 corresponds to a left side view of the device for binaural capture.

Referring to FIG. 2, in one embodiment of the invention, the upper module (1) is separated from the lower module (2) in a cross-cutting manner through a separation bend (12). The separation bend (12) is the curve of contact between the upper module (1) and the lower module (2). The separation bend (12) runs from the rear of the artificial head; it passes through the base of the skull to the cheekbones, it goes down the cheek to the lips and ends at the top of the mouth, between the philtrum and the upper lip of the artificial head.

Figure 3:
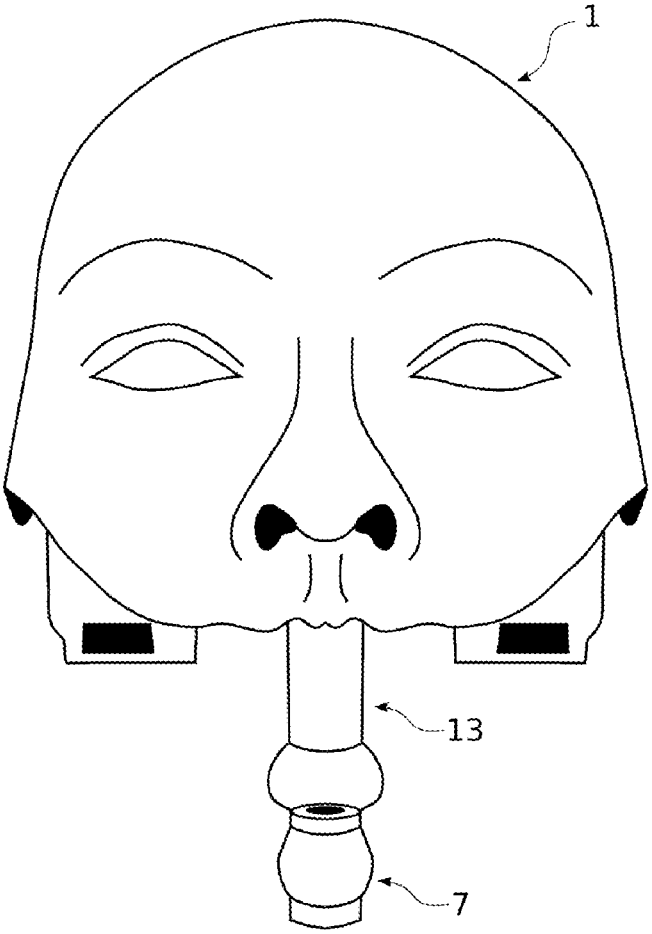
FIG. 3 corresponds to a front view of the device for binaural capture in one embodiment of the invention.

Referring to FIG. 3, in one embodiment of the invention, the upper module (1) has a front face with human face morphology and describes physical characteristics for nose and eyes. In this embodiment of the invention, the upper module (1) is responsible for the resulting HRTF and consequently, reduces the weight and size of the device for binaural capture not having the lower module (2).

Figure 4:
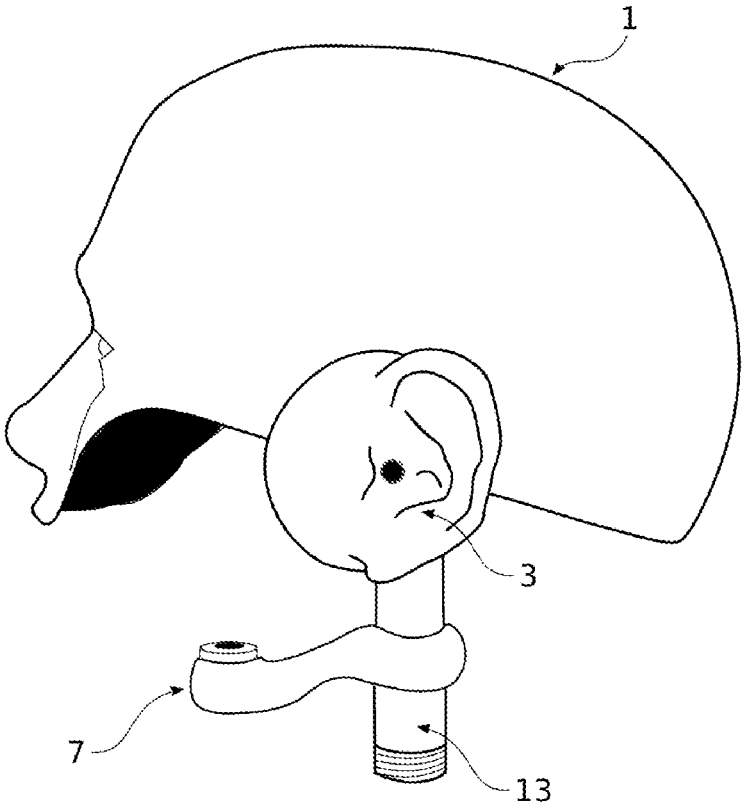
FIG. 4 corresponds to a left side view of the device for binaural capture in one embodiment of the invention.

Referring to FIG. 4, in one embodiment of the invention, the device for binaural capture comprises a central axis (13) passing through the upper module (1) along the longitudinal axis of the head. The central axis (13) connects the upper module (1) with the clamp-coupling device (7). In one embodiment of the invention the central axis (13) is a hollow cylindrical tube with a threaded end where the adjusting nut (10) is screwed. The adjusting nut (10) allows mounting and securing the lower module (2) to the upper module (1). The clamp-coupling device (7) is connected to cameras, tripods and bases through adapters and/or connectors. In one embodiment of the invention, it is performed through a screw adapter 34 "16 UC, specified under ISO 1222: regulation: 2010.

Figure 9:
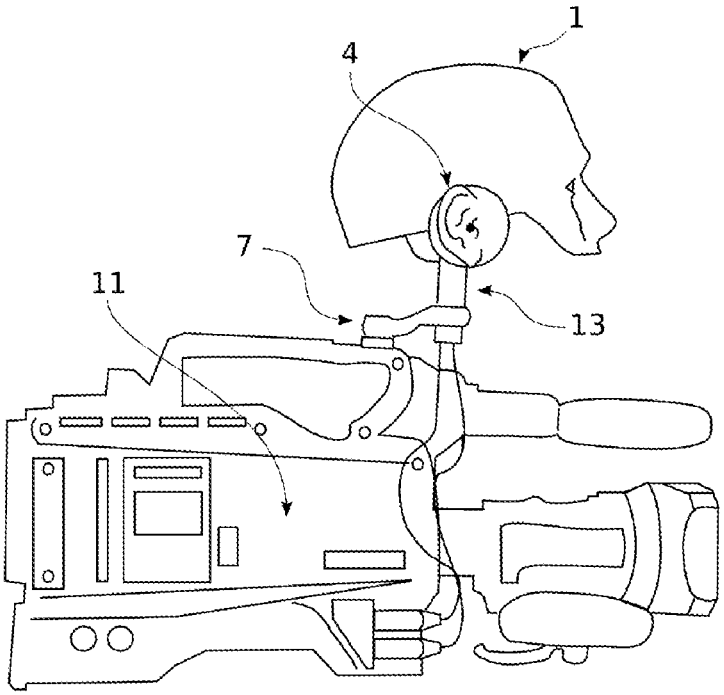
FIG. 9 corresponds to a right side view of the upper module of the device for binaural capture in one embodiment of the invention.

Referring to FIG. 4 and FIG. 9, in one embodiment of the invention, the upper module (1) allows the coupling to recording systems of audio and video compacts as, for example, an audio and video recording device of size comparable to a video camera (11). The coupling is performed through the clamp-coupling device (7). In one embodiment of the invention, the video camera (11) is of the type of digital single-lens reflex camera or DSLR, by its initials in English.

Figure 5:
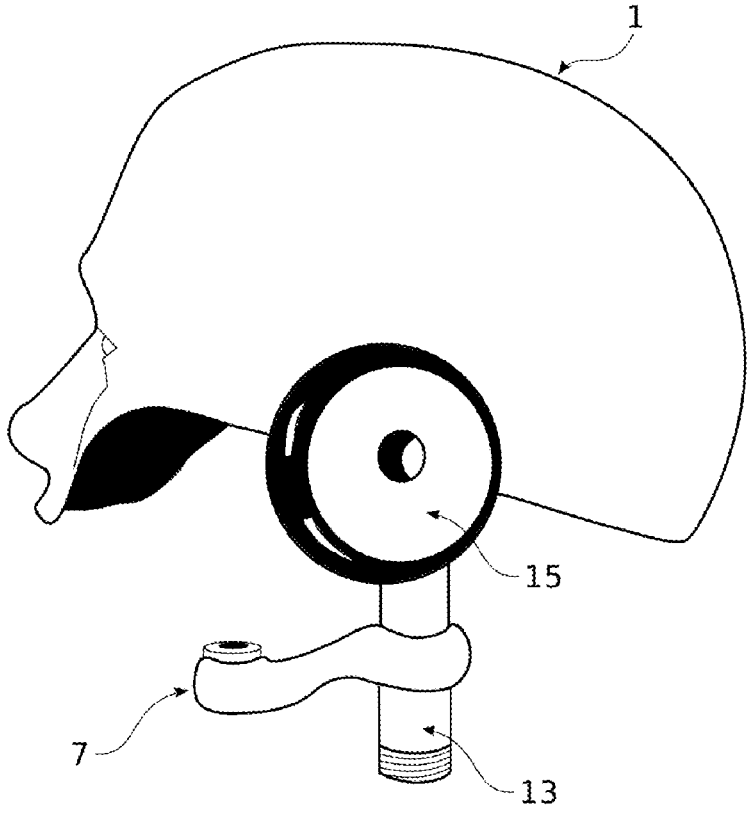
FIG. 5 corresponds to a left side view of the device for binaural capture in one embodiment of the invention.

Referring to FIG. 5, in one embodiment of the invention, the upper module (1) of the device for binaural capture has a first housing (15). In the first housing (15), the same connects to the first external ear (3). In one embodiment of the invention the first external ear (3) is connected to the first housing (15) by pushing it and it is dismounted by pulling them out.

Figure 6:
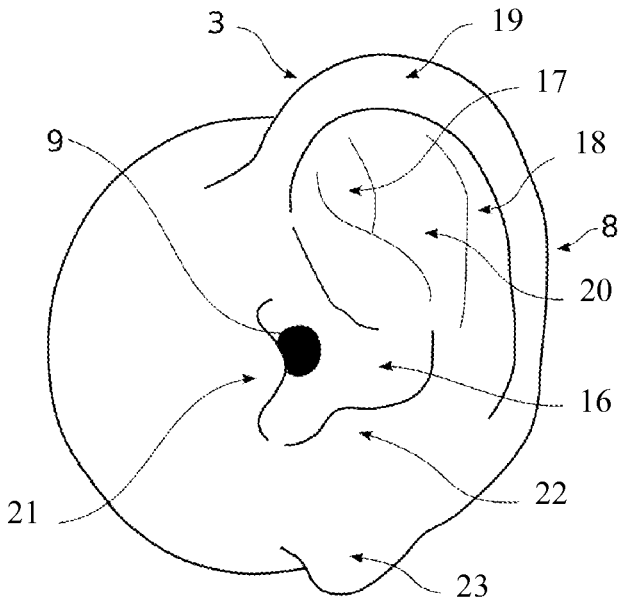
FIG. 6 corresponds to a front view of an ear of the device for binaural capture in one embodiment of the invention.

Referring to FIG. 6, in one embodiment of the invention, the first external ear (3) comprises a pinna (8) and an ear canal (9). The first external ear (3) is removable by pulling it out of the device for binaural capture. The location and orientation of the first external ear (3) with respect to the artificial head is similar to the morphology and dimensions of a human head.

Referring to FIG. 6, in one embodiment of the invention, the first external ear (3) has a morphology similar to that of a human ear. The first external ear (3) comprises the following parts: an auricular shell (16), a triangular pit (17), a scaphoid fossa (18), a helix (19), antihelix (20), a drink (21), one antitragus (22) and a lobe (23). Parts of the human ear contribute to a defined location especially in the elevation plane. Moreover, parts of the human ear individualize the frequency response of the device in high-middle frequencies.

In one embodiment of the invention, the left external ear (3) and the external right ear (4) are detachable; so as to allow to be exchanged for other external ears, for example, simplified external ears. External ears can be simplified, for example, they may be fit or may be manufactured as to facilitate maintenance or replacement of microphones that they host.

Figure 7:
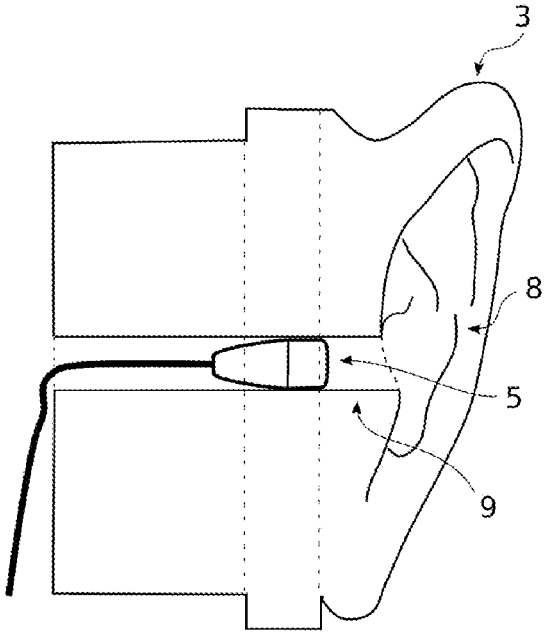
FIG. 7 corresponds to a sectional side view of an ear of the device for binaural capture in one embodiment of the invention.

Referring to FIG. 7 the first external ear (3) comprises an ear canal (9) and a transducer (5) located in the ear canal (9). The transducer (5) functions as an eardrum that receives sound pressure. In one embodiment of the invention, the two transducers (5) are omnidirectional microphones. These two transducers (5) have an omnidirectional polar pattern and a diaphragm is located inside the ear canal (9). In one embodiment of the invention, the ear canal (9) is a cylindrical tube of 2.5 cm nominal diameter.

In one embodiment of the invention, the two transducers (5) are selected from the group comprising: dynamic microphones, condenser microphones, microphones with low self-noise and microphones that generally have low impedance and frequency response. For example, in one embodiment of the invention, the two transducers (5) are microphones with frequency response between 20 Hz and 20 Khz, diaphragm between 4 mm and 25.4 mm, sensitivity from 2 to 50 mV/pa @ 1 Khz, maximum sound pressure level between 100 and 160 dB spl and levels THD<1%.

Referring to FIG. 8, in one embodiment of the invention, the artificial head, configured by the upper module (1) and the lower module (2) is bisected by the central axis (13) connecting the artificial head to the clamp-coupling (7). In one embodiment of the invention, the central axis (13) enters below the lower module (2) up to the upper module (1) without passing completely through the upper module (1). The central axis (13) is arranged along the longitudinal axis of the head.

Referring to FIG. 8, in one embodiment of the invention, the binaural capture device has a base (24) with support brackets (25) to locate the device on a surface so that it remains stable. In one embodiment of the invention the device for binaural capture has four support brackets (25) that are located equidistantly toward the periphery of the base of the binaural capture device. In one embodiment of the invention each support bracket (25) is made of rubber and is shaped like a truncated cone.

Referring to FIG. 8, towards the center of the front of the base there is a first threaded hole (26). In the first threaded hole (26) elements, for example, microphone stands, tripods or adapters screw are screwed. In one embodiment of the invention, these elements are screwed with ¼ "screw 20 UNC specified under ISO 1222 regulation. 2010. In the rear center part of the device for binaural capture there is a second threaded hole (27) for screwing the grip handle head or any base or adapter for example with screw 34"16 UNC, specified under ISO 1222 regulation: 2010. In the center of base binaural capture device is an adjusting nut (10) coupling the lower module (2) to the upper module (1) not shown, through the central axis (13). In one embodiment of the invention, through the central axis (13) and the adjusting nut (10) of the central axis (13) there passes the wiring of the two transducers (5) located in the ear canal (9) of the first external ear (3) and the ear canal (9) of the external second ear (4).

Referring to FIG. 9, in one embodiment of the invention, the upper module (1), is mounted on the video camera (11) by the clamping-coupling (7) of the device for binaural capture. The clamping-coupling (7) is a shoe adapter specified according to ISO 518: 2006. The clamping coupling (7) is connected to the central axis (13) of the device for binaural capture.

Figure 10:
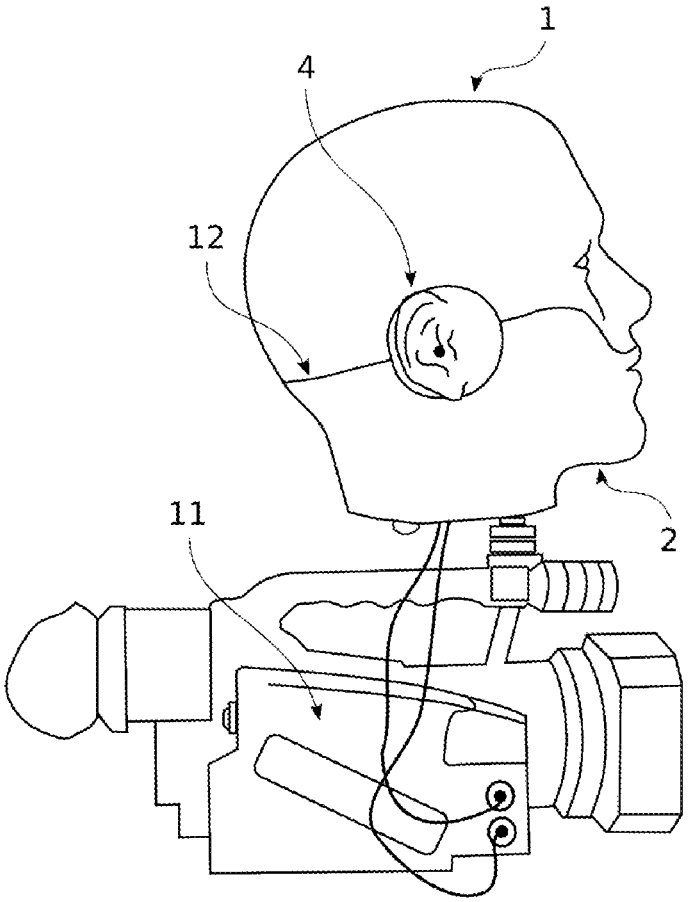
FIG. 10 corresponds to a right side view of the device for binaural capture in one embodiment of the invention.

Referring to FIG. 10, in one embodiment of the invention, the device for binaural capture is installed with the upper module (1) and the lower module (2) to a video camera (11) through a shoe adapter threaded to the first screw hole (26), not shown.

Figure 11:
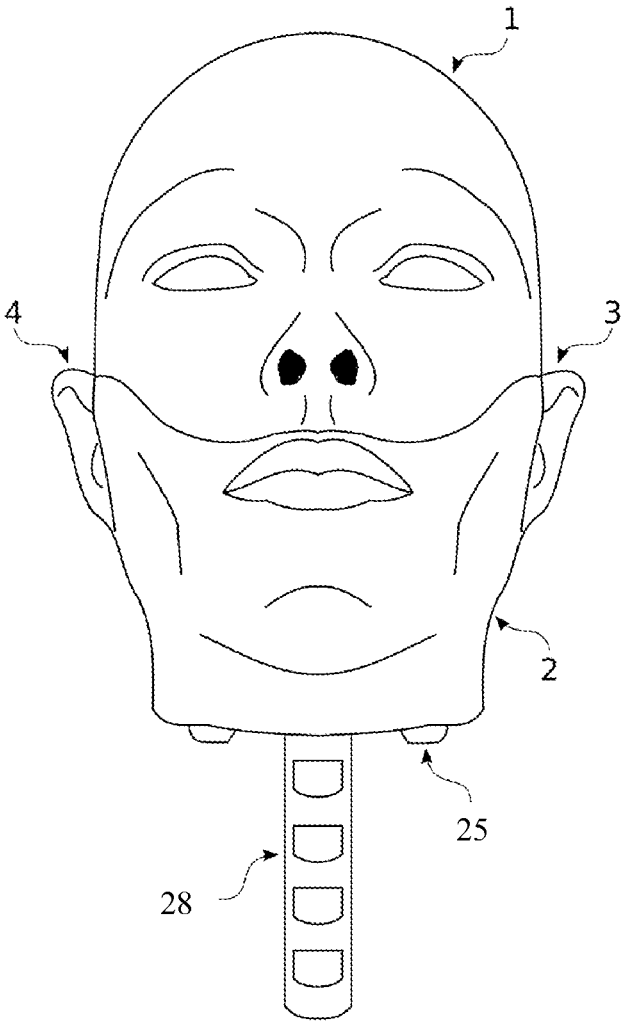
FIG. 11 is a front view of the device for binaural capture.

Referring to FIG. 11, the binaural capture device has a gripping handle (28) which is screwed into the second threaded hole (27) of the base of the lower module (2). The gripping handle (28) is used to operate the binaural capture device freely like a handheld microphone.

In one embodiment of the invention, the artificial head is constructed with fibre-reinforced plastics, for example, acrylic resin reinforced with fiber glass. The fibre-reinforced plastics provide a solid structure to ensure durability of the device to be subject to field work; additionally the fibre-reinforced plastics have a low weight compared with other materials, such as metals. The low weight facilitates the manoeuvre of the binaural capture device. The first external ear (3) and the second external ear (4) are made of silicone. The silicone can provide an acoustic impedance similar to the impedance of the human skin. The upper part of the head is provided with absorbing acoustic material that serves to dampen resonances caused inside the binaural capture device.

In one embodiment of the invention, the color of the artificial head is in dark tones and matte texture that avoids the reflection of lights in audiovisual productions. These tones and texture are a response to the need to adapt the working environment of audiovisual production and film shooting, especially in the areas of art direction and cinematography. The device must not emit reflections and should be easy to mimic among the scenographic elements of each production, this allows capturing sound from different places to the location of the cameras.

In one embodiment of the invention, the audio video recording device is stereo and allows the capture of the left and right channels corresponding to microphones located on the first external ear (3) and the second external ear (4).

In one embodiment of the invention, the two transducers (5) are connected to the audio video recording device via balanced three-pin XLR connectors. The audio video recording device contains preamplifiers per channel and digital analog converters with resolutions of sampling frequencies between 44, 1 kHz, 48 kHz, 96 kHz and 192 kHz, and bit depth of 16 and 24 bits.

In one embodiment of the invention the audio/video recording device contains a digital audio storage unit in uncompressed format using pulse code modulation by its English acronym PCM.

Example of Embodiment

In FIG. 12 to FIG. 16 the HRTF results are shown in the frequency domain measured for the binaural capture device with artificial head and the binaural capture device only with the upper module (1), at different angles in azimuth and elevation.

Response values in frequency of the binaural capture device were obtained from impulse response measurements. Measurements were performed in an acoustically conditioning enclosure with a volume of approximately 60 $m^3$. The enclosure has an acoustic and structural insulation that allows having a lower background noise to 29 dB (A). The enclosure has an acoustic treatment for reverberation control, with which it has an average reverberation time of 0.47 seconds, which is an average between the bands of 500 and 1000 Hz.

The impulse response measurements were performed using a loudspeaker as a source, with flat frequency response. The loudspeaker emits a wideband signal in frequency to the binaural capture device located at a fixed distance in front of the loudspeaker. The distance between source and device took into account the concept of critical distance, which distinguishes the distance from which it passes from the field direct sound to the reverberant field, being this distance a function of the directivity characteristics of the source and the acoustic conditions of the enclosure. The distance between source and device was less than the critical distance in order to measure in the field of direct sound. The measurement was performed for five source positions forming an angle of elevation relative to the head from −30° to +30° in increments of 15°. For each elevation angle the response to the impulse of the left and right ears was measured, rotating the head in clockwise direction about its longitudinal axis (azimuth angle) with increments of 15°.

In FIG. 12 to FIG. 16, five specific measurements show the impulse responses corresponding to the first external ear (3) and the second external ear (4). The ordinate axis in the figures represents the decibel level of the response obtained from the envelope of the Fast Fourier Transform (FFT from now, by its acronym in English) of the impulse responses. The sampling frequency was 44.1 kHz and FFT size, 4096 samples. The abscissa represents frequency in Hertz, indicating the center frequencies of octave bands from 63 Hz up to 16 kHz band. The dotted line indicates the measurement of the binaural capture device with the upper module (1) and the continuous line indicates the measurement of the binaural capture device with artificial head.

Figure 12:
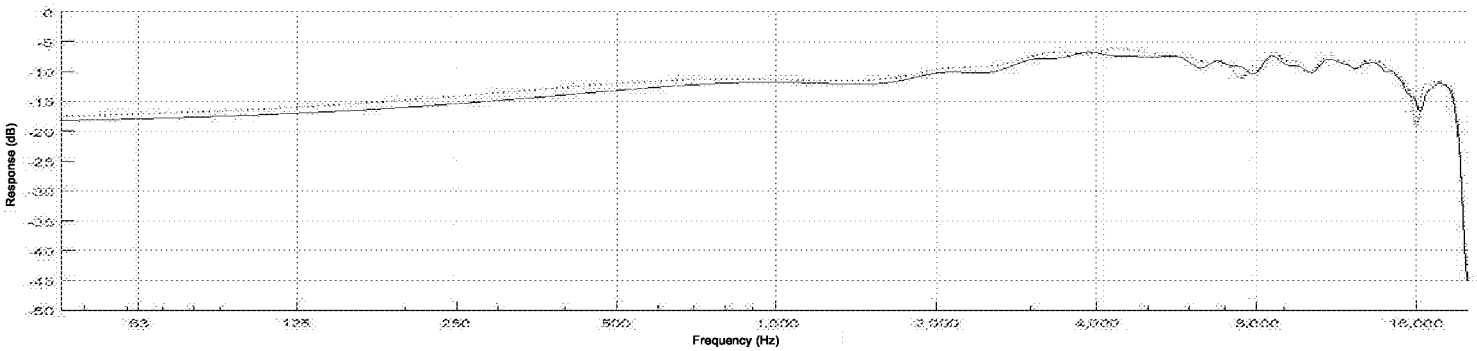
FIG. 12 corresponds to the comparison in a specific spatial configuration of the frequency response of transfer function of the device for binaural capture for the first external ear a) and the second external ear b) when the device for binaural capture comprises the artificial head (continuous line) and when it comprises only the upper module (dotted line).
Figure 12:
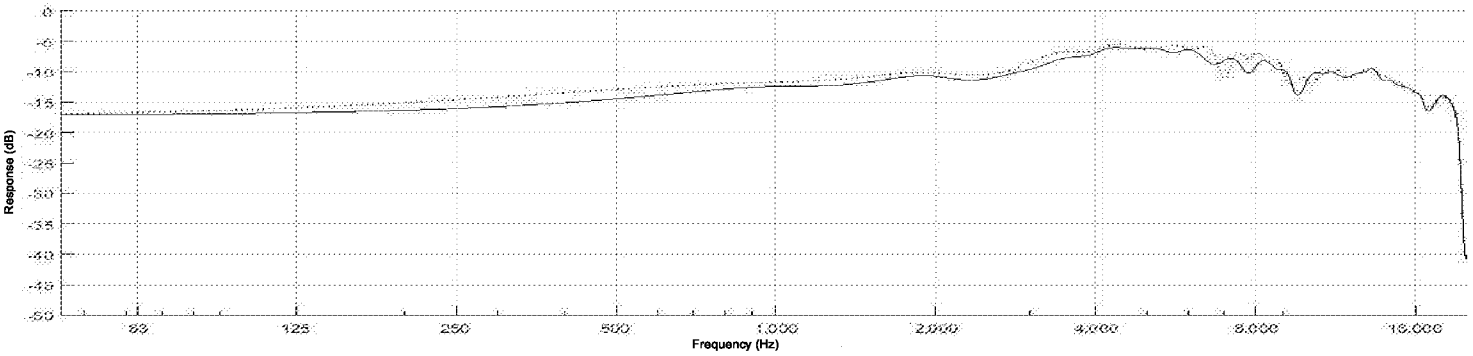

Referring to FIG. 12, it is measured the frequency response of the binaural capture device for a head orientation to 0° azimuth and elevation 0°. FIG. 12 *a*) illustrates the frequency responses got from the first external ear (3) and FIG. 12 *b*) illustrates the frequency responses obtained from the second external ear (4). It can be seen in FIG. 12 *a*) and FIG. 12 *b*) that there are no major differences between 5 dB frequency response of the binaural capture device measured with artificial head, and the binaural capture device measured with the top module (1). The greatest differences are in the range close to 16 kHz for the first external ear (3) and 7 kHz for external second ear (4).

Figure 13:
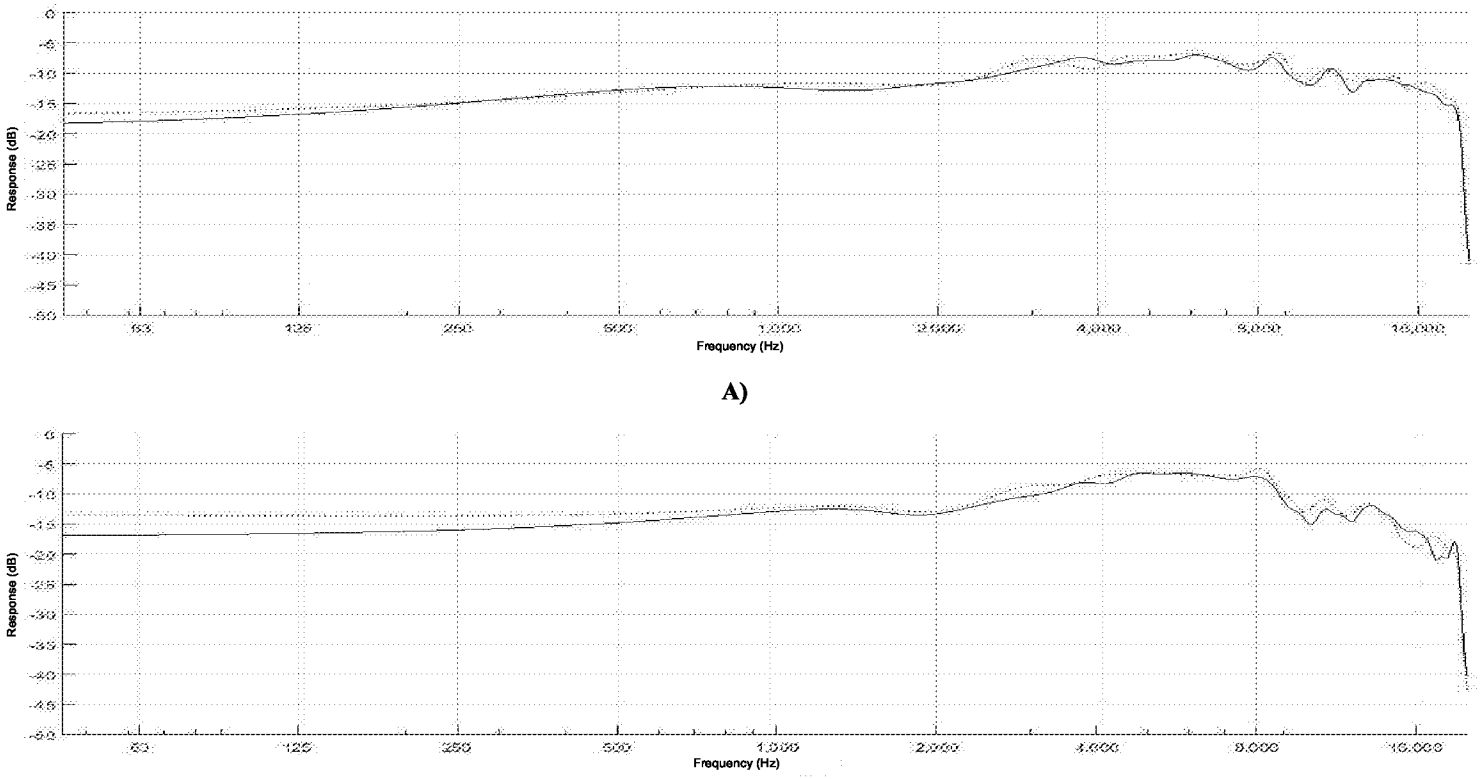
FIG. 13 corresponds to the comparison in a specific spatial configuration of the frequency response of transfer function of the device for binaural capture for the first external ear a) and the second external ear b) when the device for binaural capture comprises the artificial head (continuous line) and when it comprises only the upper module (dotted line).

Referring to FIG. 13, it is measured the frequency response of the binaural capture device for a head orientation to 0° azimuth and 30° elevation. FIG. 13 *a*) illustrates the frequency responses obtained from the first external ear (3) and FIG. 13 *b*) illustrates the frequency responses obtained from the second external ear (4). It can be seen in FIG. 13 *a*) and FIG. 13 *b*) that there are no major differences to 5 dB between the frequency response of the binaural capture device measured with respect to the artificial head and with respect to the binaural capture device measured only with the upper module (1). The greatest differences are in the range near 4 kHz for the first external ear (3) and 16 kHz for external second ear (4).

Figure 14:
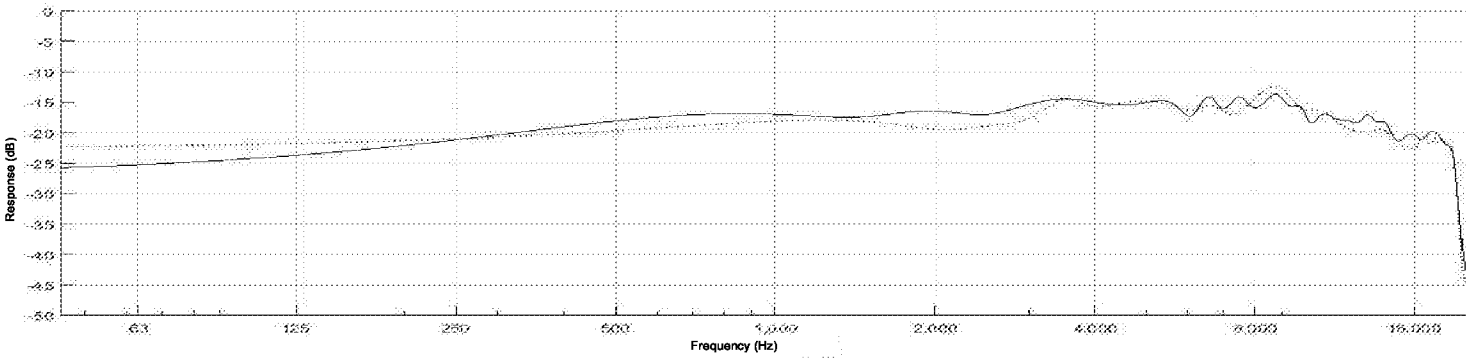
FIG. 14 corresponds to the comparison in a specific spatial configuration of the frequency response of transfer function of the device for binaural capture for the first external ear a) and the second external ear b) when the device binaural capture for the first external ear) and the second external ear b) when the device for binaural capture comprises the artificial head (continuous line) and when it comprises only the upper module (dotted line).
Figure 14:
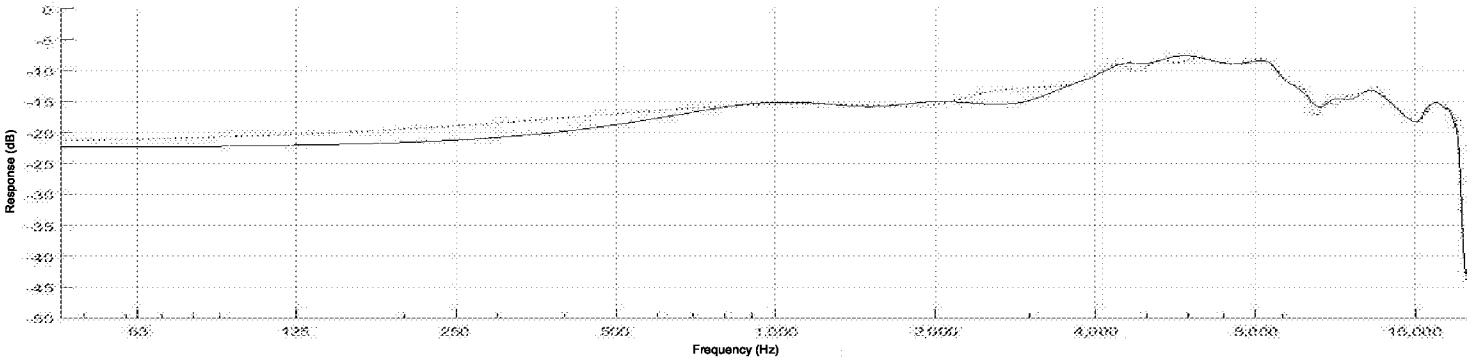

Referring to FIG. 14, it is measured the frequency response of the binaural capture device for a head orientation to 90° azimuth and 0° elevation. FIG. 14 *a*) illustrates the frequency responses got from the first external ear (3) and FIG. 14 *b*) illustrates the frequency responses obtained from the second external ear (4). It can be seen in FIG. 14 *a*) and FIG. 14 *b*) that there are no major differences between 5 dB frequency response binaural capture device measured with respect to the artificial head capture device binaural measured only with the upper module (1). The greatest differences are in the range near 2 kHz for the first external ear (3) and 3 kHz for external second ear (4).

Figure 15:
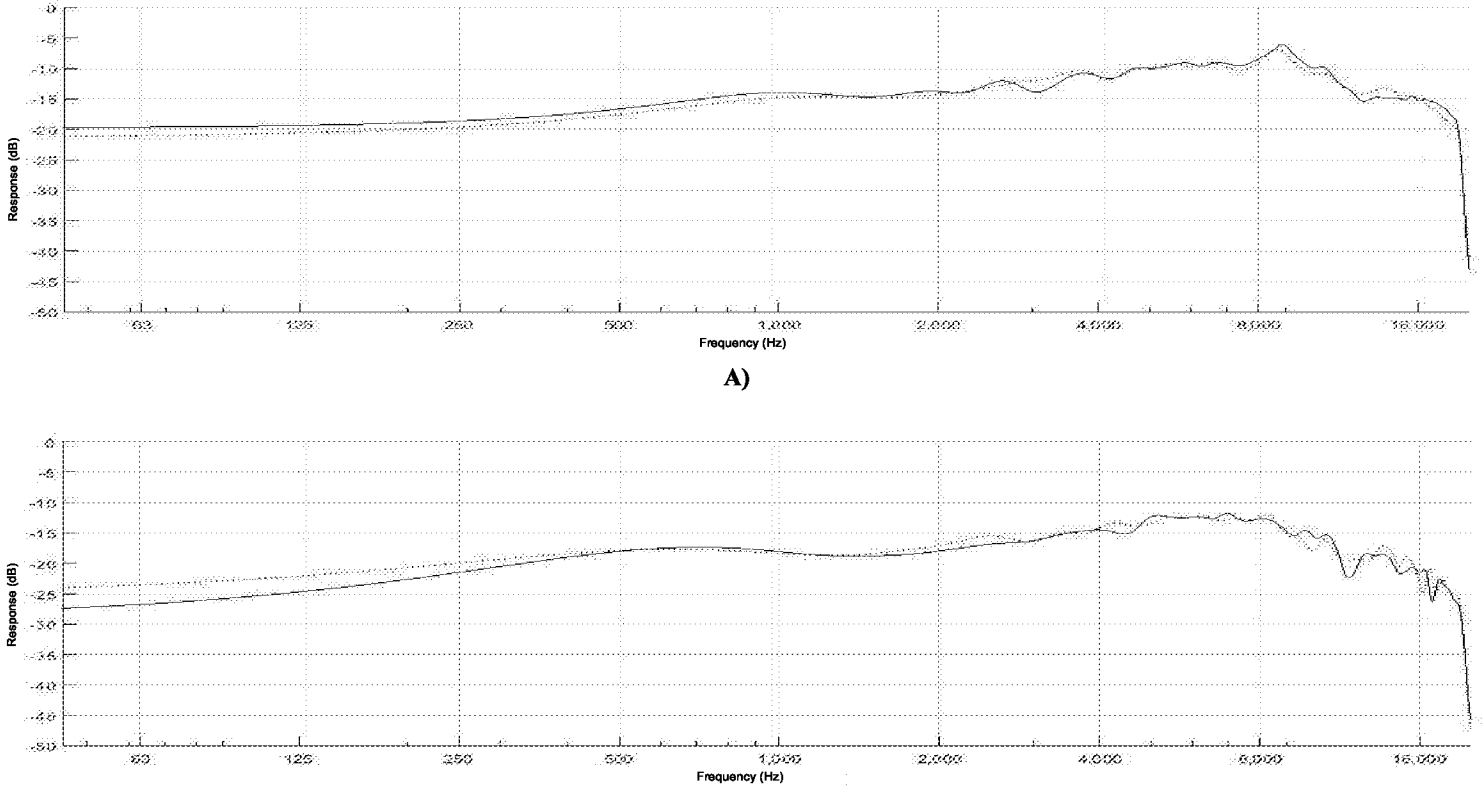
FIG. 15 corresponds to the comparison in a specific spatial configuration of the frequency response of transfer function of the device for binaural capture for the first external ear a) and the second external ear b) when the device for binaural capture comprises the artificial head (continuous line) and when it comprises only the upper module (dotted line).

Referring to FIG. 15, it is measured the frequency response of the binaural capture device for a head orientation to 270° azimuth and 30° elevation. FIG. 15 *a*) illustrates the frequency responses got from the first external ear (3) and FIG. 15 *b*) illustrates the frequency responses obtained from the second external ear (4). It can be seen in FIG. 15 *a*) and FIG. 15 *b*) that there are no major differences to 5 dB between the frequency response of the binaural capture device measured with respect to the artificial head and the binaural capture device measured only with the upper module (1). The greatest differences are in the range near 3 kHz for the first external ear (3) and 10 kHz for external second ear (4).

Figure 16:
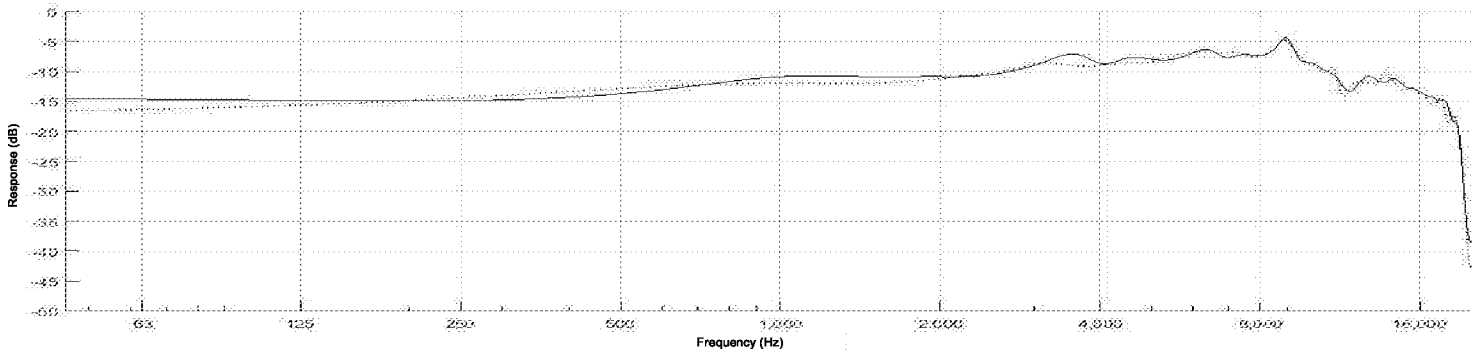
FIG. 16 corresponds to the comparison in a specific spatial configuration of the frequency response of transfer function of the device for binaural capture for the first external ear a) and the second external ear b) when the device for binaural capture comprises the artificial head (continuous line) and when it comprises only the upper module (dotted line).
Figure 16:
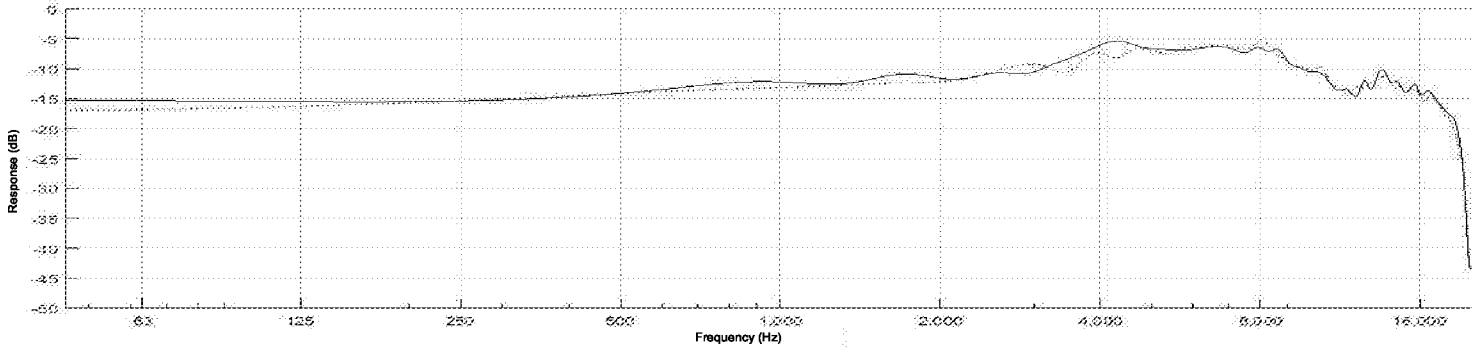

Referring to FIG. 16, it is measured the frequency response of the binaural capture device for a head orientation to 180° azimuth and 15° elevation. FIG. 16 *a*) illustrates the frequency responses got from the first external ear (3) and FIG. 16 *b*) illustrates the frequency responses obtained from the second external ear (4). It can be seen in FIG. 16 *a*) and FIG. 16 *b*) that there are no major differences to 5 dB between the frequency response of the binaural capture device measured with respect to the artificial head and the binaural capture device measured only with the upper module (1). The greatest differences are in the range near 4 kHz for the first external ear (3) and 4 kHz for external second ear (4).

For all measurement examples shown in figures FIG. 12 to FIG. 16 it can be seen that variations in level of the frequency responses between the binaural capture device with artificial head and the binaural device only with the top module (1) are less than 5 dB, in general. These differences are presented with greater emphasis for specific frequency ranges which means that the results obtained when performing a sound capture in case of using only the upper module (1) of the binaural capture device are similar to those obtained with the binaural capture device with artificial head. These tests are performed keeping spaciousness characteristics, location and depth of sound sources, typical features of a sound binaural capture.

It must be understood that the present invention is not limited to the embodiments already described and illustrated, because as it will be obvious for one skilled person in the art, there are possible variations and modifications that do not deviate from the spirit of the invention, which is only defined by the following claims.

What is claimed is:

1. A device for binaural capture of sound comprising:

an upper module;

a first external ear and a second external ear incorporated into the upper module in a removable way;

two transducers, a transducer is arranged in the first external ear and the other transducer is arranged in the second external ear;

a central axis passing through the upper module;

a clamping-coupling connected to the central axis;

an audio video recording device connected to the clamping-coupling;

wherein the upper module is mounted on the audio video recording device via the clamping-coupling and the central axis; and wherein the two transducers are connected to the audio video recording device by wiring that passes through the central axis.

2. The device of claim 1, comprising a lower module coupled to the bottom part of the upper module, configuring an artificial head.

3. The device of claim 2, characterized in that the artificial head is of a dark color and matte texture.

4. The device of claim 2, characterized in that the artificial head has a front face with human face morphology.

5. The device of claim 1, characterized in that the two transducers are omnidirectional microphones.

6. The device of claim 1, characterized in that the two transducers are selected from the group comprising dynamic microphones, condenser microphones, microphones with frequency response from 20 Hz to 20 kHz, diaphragm microphones between 4 mm and 25.4 mm, sensitivity microphones from 2 to 50 mV @ 1Khz, microphones with maximum sound pressure level between 100 and 160 dB SPL, microphones with distortion levels THD<1% and combinations thereof.

7. The device of claim 1, characterized in that the first external ear and the second external ear have the morphology of a human ear.

* * * * *